United States Patent [19]

Smith

[11] Patent Number: 5,018,574

[45] Date of Patent: May 28, 1991

[54] TUBING CONVEYED WELLBORE FLUID FLOW MEASUREMENT APPARATUS

[75] Inventor: Lonnie J. Smith, Allen, Tex.

[73] Assignee: Atlantic Richfield Company, Los Angeles, Calif.

[21] Appl. No.: 436,850

[22] Filed: Nov. 15, 1989

[51] Int. Cl.[5] ..... E21B 23/06; E21B 33/127

[52] U.S. Cl. ..... 166/185; 166/65.1; 166/187; 166/188; 166/145; 166/151; 166/66

[58] Field of Search ..... 73/155, 861.77; 166/55.1, 64, 65.1, 66, 122, 145, 151, 181, 185, 187, 188, 250

[56] References Cited

U.S. PATENT DOCUMENTS

| | | | |
|---|---|---|---|
| 2,829,518 | 4/1958 | Rumble et al. | 73/155 |
| 3,036,460 | 5/1962 | White et al. | 73/155 |
| 3,066,739 | 12/1962 | Saurenman et al. | 73/155 |
| 3,103,812 | 9/1963 | Bourne, Jr. et al. | 166/187 |
| 3,107,729 | 10/1963 | Barry et al. | 166/66 |
| 3,292,431 | 12/1966 | Young | 73/155 |
| 3,776,308 | 12/1973 | Malone | 166/187 |
| 4,420,159 | 12/1983 | Wood | 166/151 |
| 4,759,406 | 7/1988 | Smith et al. | 166/65.1 |
| 4,787,446 | 11/1988 | Howell et al. | 166/187 |
| 4,830,105 | 5/1989 | Petermann | 166/241 |

OTHER PUBLICATIONS

Wade et al., "Production Logging-The Key to Optimum Well Performance", Journal of Petroleum Technology, Feb. 1965, pp. 137-144.

*Primary Examiner*—Bruce M. Kisliuk

[57] ABSTRACT

Wellbore fluid flow rates and other fluid properties may be measured by a tool which is insertable in the wellbore on the end of a tubing string and includes an instrument section and an inflatable packer disposed on the tool for inflation by conducting pressure fluid down the tubing string to the packer. A control valve disposed on the tool is hydraulically shiftable between first and second positions for conducting fluid from the tubing string to the packer and from the packer to the exterior of the tool. The valve may be actuated by fluid conducted down the tubing string. The tool includes housing parts having respective cavities for conducting wellbore fluid through a flowmeter and for containing instrument circuit enclosures disposed therein. Pressure fluid bypasses the cavities through elongated passages formed in the tool housing parts along or adjacent to the outer periphery of the housing parts. A frangible coupling is interposed in the tool between the packer and the instrument section.

16 Claims, 6 Drawing Sheets

TUBING CONVEYED WELLBORE FLUID FLOW MEASUREMENT APPARATUS

BACKGROUND OF THE INVENTION

1. Field of the Invention

The present invention pertains to a wellbore fluid flow measurement apparatus which is adapted to be conveyed into and out of a wellbore by coilable tubing having a wireline-type cable disposed therein.

2. Background

It is often necessary to evaluate the type of fluid and the fluid flow rate entering a wellbore at different intervals to evaluate fluid reservoir performance. Robert W. Siegfried et al U.S. Pat. No. 4,928,759 issued May 29, 1990, and assigned to the assignee of the present invention is directed to certain improvements in tubing conveyed wellbore fluid flow measurement systems. A publication entitled: "Production Logging—The Key to Optimum Well Performance" by R. T. Wade, et al, *Journal of Petroleum Technology*, February, 1965, Society of Petroleum Engineers, Richardson, Tex., describes a combination inflatable packer and flowmeter for evaluating the flow of wellbore fluids at selected intervals of production from a reservoir. Certain improvements in a flowmeter type instrument or apparatus of the general type set forth in the above-mentioned publication have been considered desirable including the overall arrangement of the components of the apparatus, the provision of means for conveying operating fluid to the inflatable packer and a control valve for operation of inflating and deflating the packer. These improvements are addressed in regard to the present invention and are set forth in general in the summary and more fully in the detailed description which follows.

SUMMARY OF THE INVENTION

The present invention provides an improved apparatus for insertion in a wellbore for measuring the flow rate as well as certain other characteristics of fluids being produced through a wellbore. Some important aspects of the invention include the general arrangement of the components of the apparatus, the provision of an improved manner of conveying fluid to and from an inflatable packer which comprises part of the apparatus and a unique control valve which may be hydraulically operated using tubing conveyed fluid for performing operations to inflate and deflate the packer. These and other improvements and unique features of the present invention will be further appreciated by those skilled in the art upon reading the detailed description which follows in conjunction with the drawing.

DESCRIPTION OF A PREFERRED EMBODIMENT

Figure 1A:
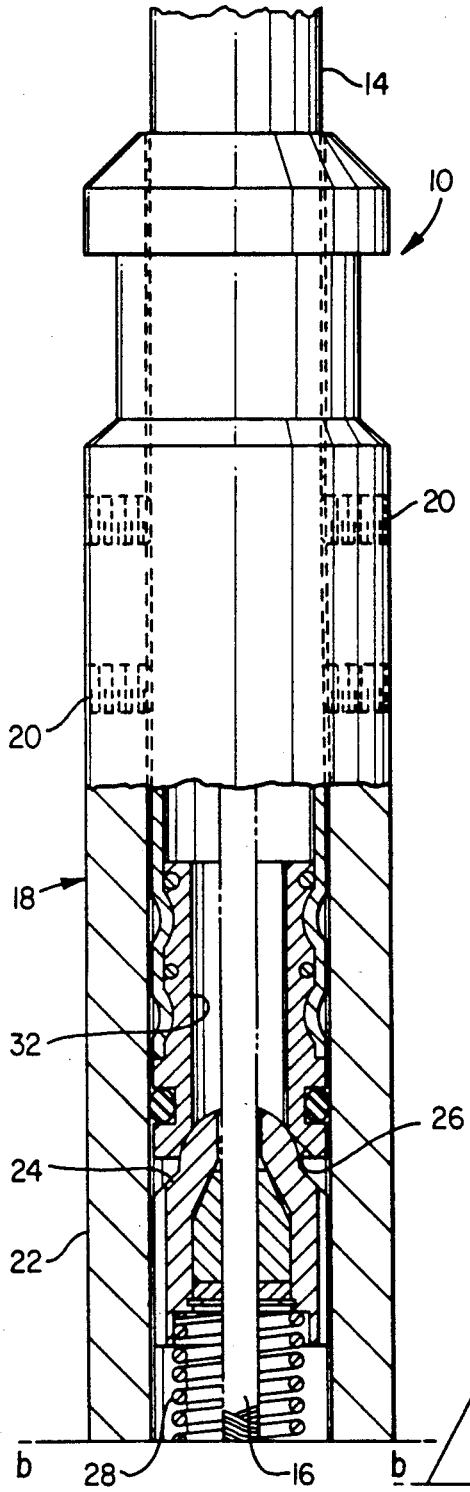
FIGS. 1A through 1I comprise a central longitudinal section view of the tool of the present invention.

In the description which follows, like parts are marked throughout the specification and drawing with the same reference numerals, respectively. The drawing figures are not necessarily to scale and certain features are shown in somewhat schematic form in the interest of clarity and conciseness. The drawing figures disclose certain details of improvements in a tubing conveyed fluid flow measurement apparatus described in the aforementioned patent application. The prior art of record in that application is not believed to be any more relevant to the present invention than it is to the invention described in the referenced patent application.

Referring to the drawing figures, the apparatus will be described generally with reference to FIGS. 1A through 1I in that order as a description of the apparatus from its so-called top end, when disposed in a generally vertical wellbore to its bottom end. The apparatus of the present invention is by no means suited only to use in vertical wellbores and, in fact, is particularly advantageous for use in deviated or generally horizontal wellbores.

Figure 1B:
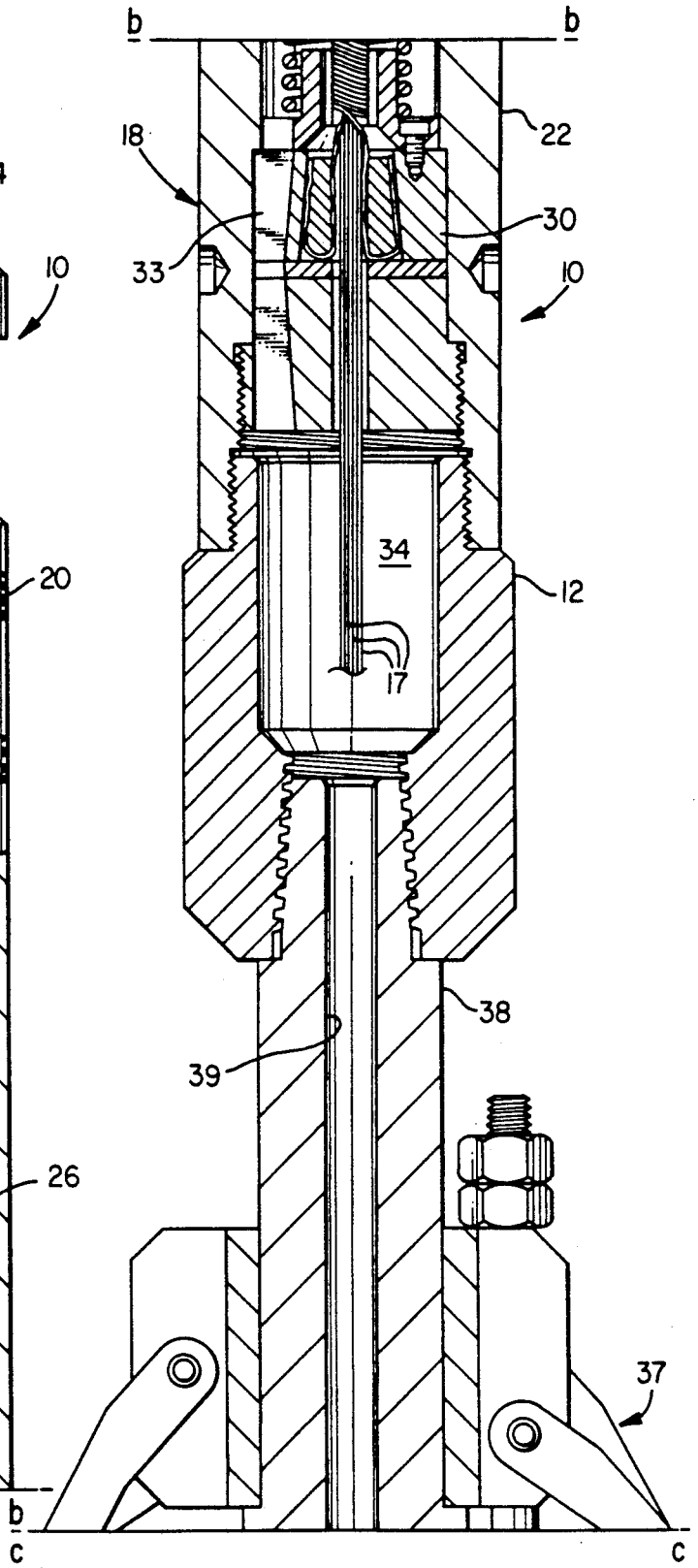

The apparatus or tool of the present invention is generally designated by the numeral 10. Referring to FIGS. 1A and 1B, the tool 10 includes a first coupling section 12 for coupling the tool to a length of coilable tubing 14, which tubing has a multi-conductor electrical cable 16 extending there-through and generally known in the art as a wireline cable. A connector 18 generally of the type described in U.S. Pat. No. 4,759,406 to the inventor and assigned to the assignee of the present invention, includes suitable means including set screws 20 for connecting a connector body 22 to the tubing 14. An internal, spring biased check valve 24 which is biased against a seat member 26 has a through passage formed therein for extension of the cable 16 therethrough. A coil spring 28 biases the check valve 24 in the closed position to substantially prevent the flow of wellbore fluids up through the coilable tubing 14. Suitable anchor means 30 are provided in the connector 18 for anchoring the structural sheath of the wireline cable 16 to the connector body. A fluid flow passage 32 is provided within the connector body 22 by way of the seat 26, and suitable passages 33 formed in the anchor means 30. Accordingly, fluid is free to flow under suitable pressure through the seat 26, with the valve closure member 24 in the open position, and the passages 33 in the anchor means 30 to an internal passage 34 within the coupling 12.

Figure 1C:
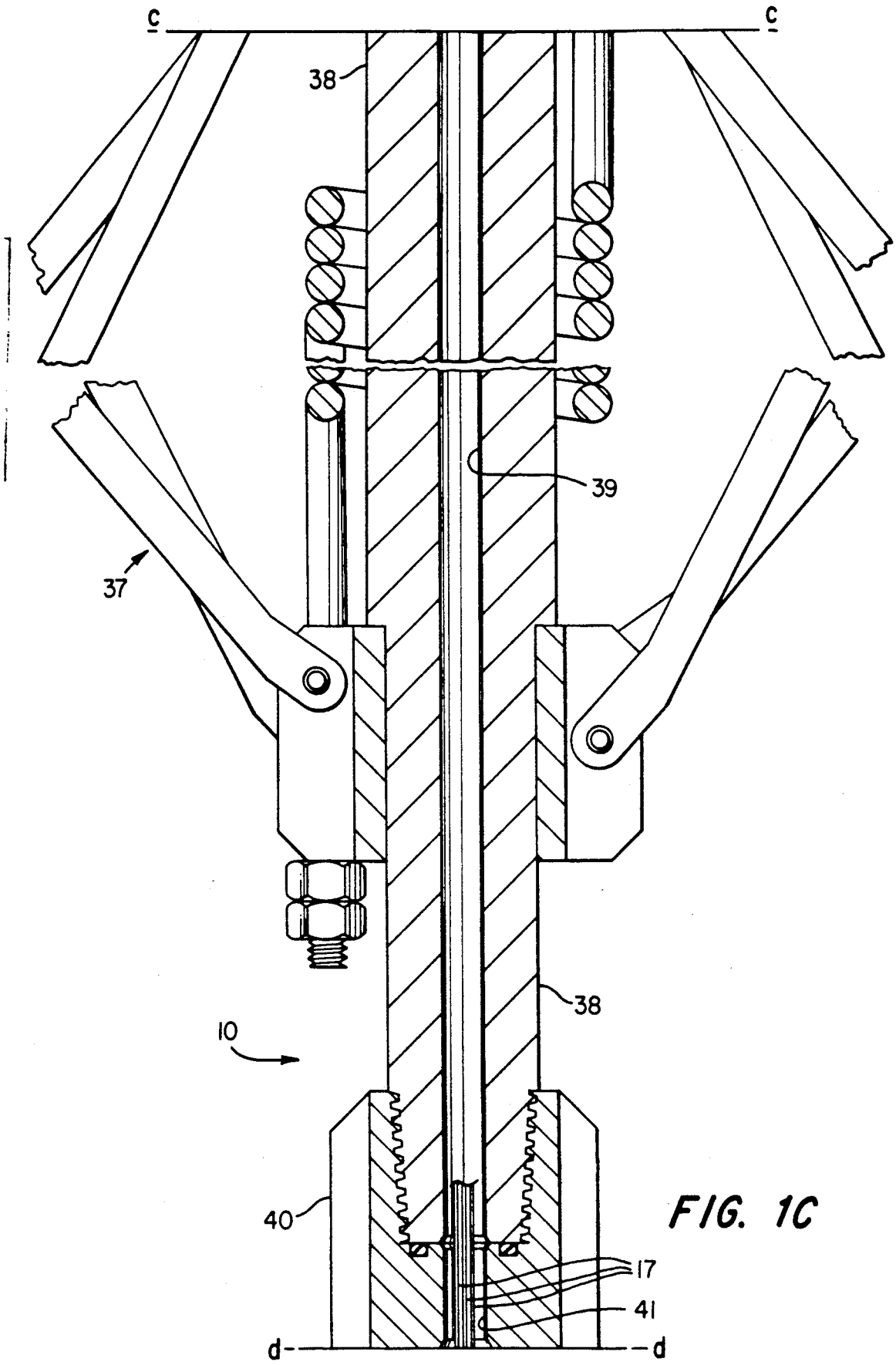

As shown in FIGS. 1B and 1C, the coupling 12 is connected to an elongated centralizer body member 38 also having an internal passage 39 formed therein for conducting fluid flow and the conductor wires 17 of the wireline cable 16 therethrough. The centralizer body 38 is adapted to support a suitable centralizer mechanism 37, not described in detail, and which may be of the type disclosed in Steven G. Petermann U.S. Pat. 4,830,105 and assigned to the assignee of the present invention. The centralizer mechanism 37 is particularly desirable for use in applications of the tool 10 in deviated or horizontal wellbores.

Figure 1D:
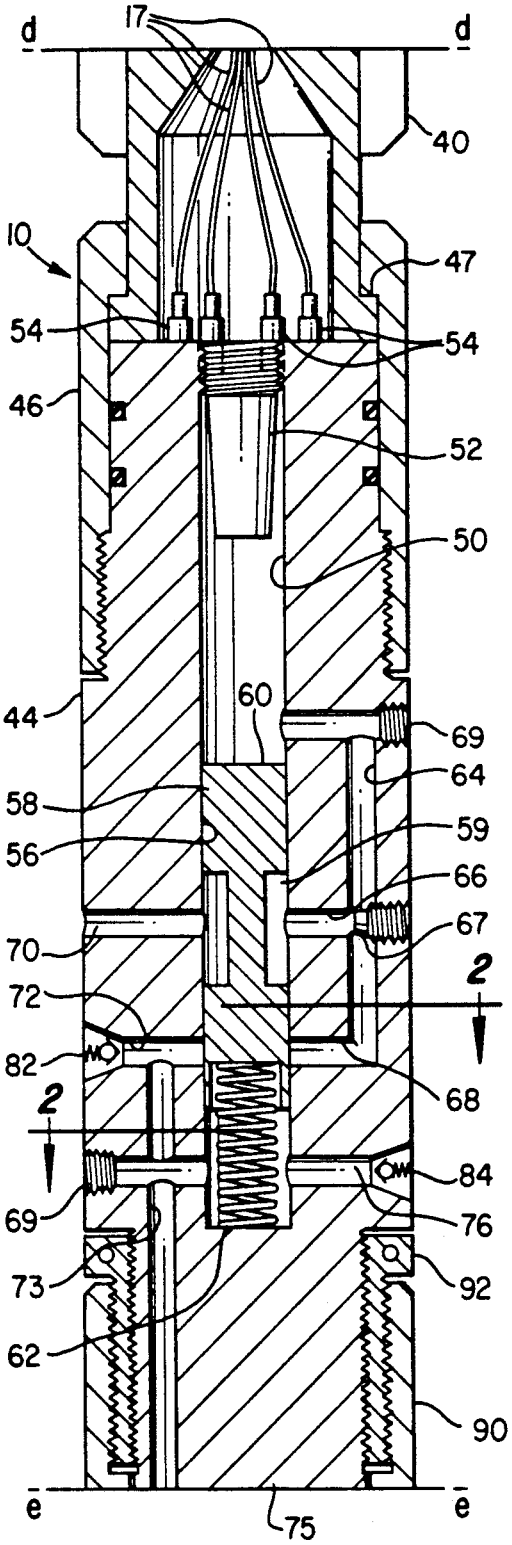

Referring now to FIGS. 1C and 1D, the centralizer body 38 is threadedly connected to an adapter part 40, also having a central passage 41 extending therethrough for conducting pressure fluid and forming a wireway for the conductor wires 17. The adapter part 40 is coupled to a tool housing part 44 by a nut 46 which is threadedly engaged with the housing part 44 and engages a transverse shoulder 47 on the adapter part.

The housing part 44 comprises an elongated, generally cylindrical member having bore 50 formed therein and in which a suitable filter element 52 may be disposed. The housing part 44 also includes a plurality of elongated passages 45, see FIG. 2, through which the conductor wires 17 may be extended and which terminate at each end of the housing part in suitable connector elements 54 and 56, respectively, see FIG. 1E also. The connector elements 54 and 56 may be of a type commercially available under the trademark Kemlon. The connector elements 54 and 56 comprise means for extending the electrical conductors 17 through the housing part 44 without leakage of pressure fluid through the passages 45. The bore 50 includes portion 56 in which a spool type valve closure member 58 is slidably disposed and movable under the urging of pressure fluid in the bore 50 from the position shown to a second position to permit the flow of pressure fluid through the housing part 44 to passage means to be described in further detail herein. The closure member 58 includes an annular recess 59 and a pilot pressure surface 60 formed thereon, the latter for urging the closure member to move to the second position. The closure member 58 is urged to the position illustrated by a coil spring 62 disposed in one end of the bore 56 and acting on the closure member 58.

Figure 1E:
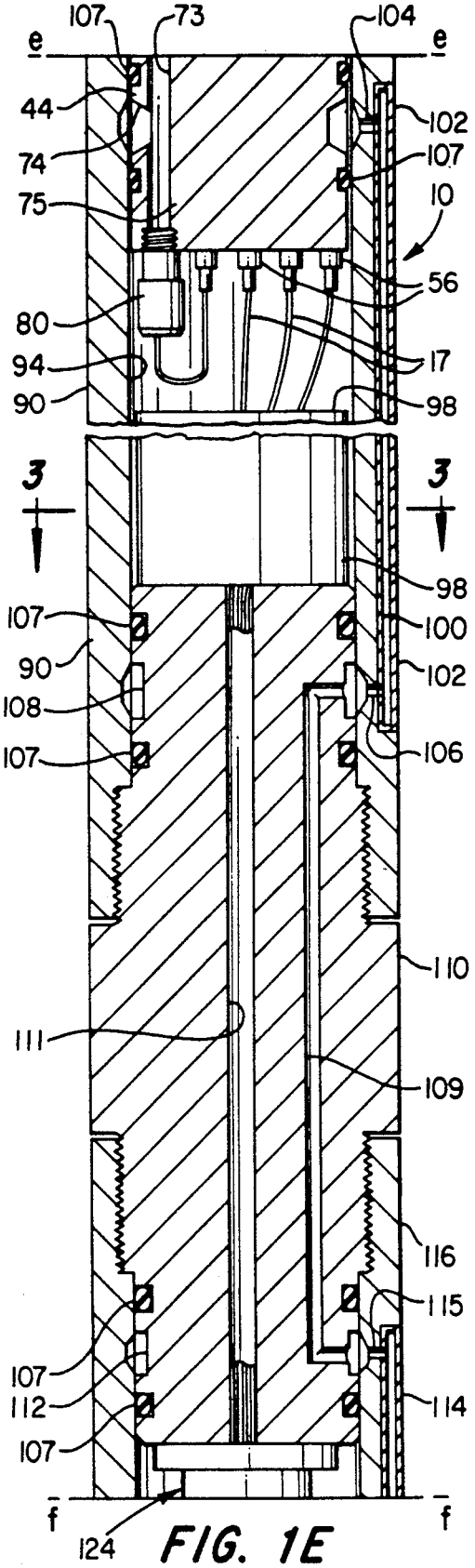
Figure 2:
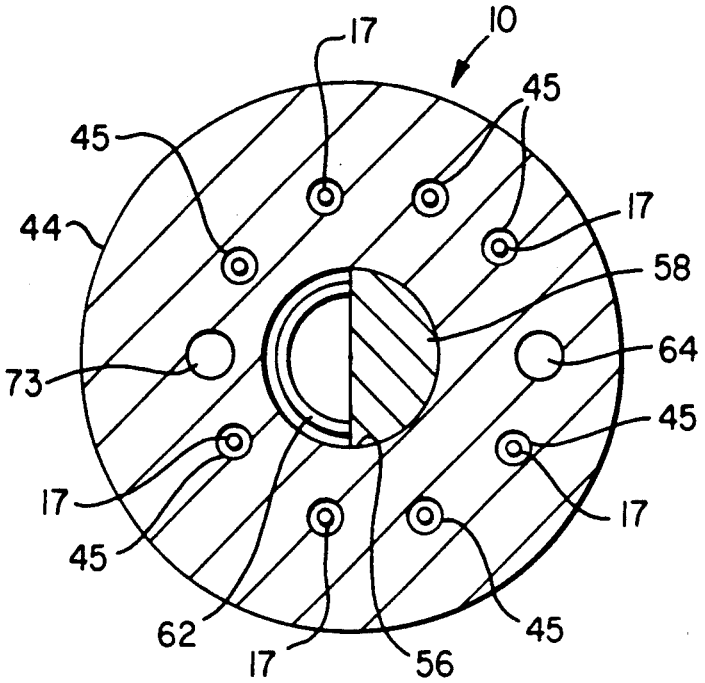
FIG. 2 is a section view taken along the line 2—2 of FIG. 1D.

The housing part 44 further includes fluid flow passages 64, 66 and 68 which are in communication with the bore 56 for conducting fluid to corresponding passages 70, and 72, respectively. As shown in FIGS. 1D and 1E, the passage 72 includes a portion 73 which extends through an end portion 75 of the body part 44 and which has a circumferential groove 74 formed thereon and in communication with the passage 73. The passage 72, 73 may also be in communication with a passage 76 opening to the exterior of the tool 10 through the housing part 44. A pressure transducer 80, FIG. 1E, is in communication with the passage 73 for sensing the pressure therein. A high-pressure relief valve 82 is in communication with the passage 72 for discharging fluid to the exterior of the tool and a low-pressure relief valve 84 is interposed in the passage 76 to vent the passage 73 and to prevent the flow of wellbore fluids into the bore 56 or the passages 72, 73. As shown in FIG. 1D, an adjustable flow control valve 67 is interposed between the passages 64 and 66 and plugs 69 close the respective passage ends illustrated.

Figure 3:
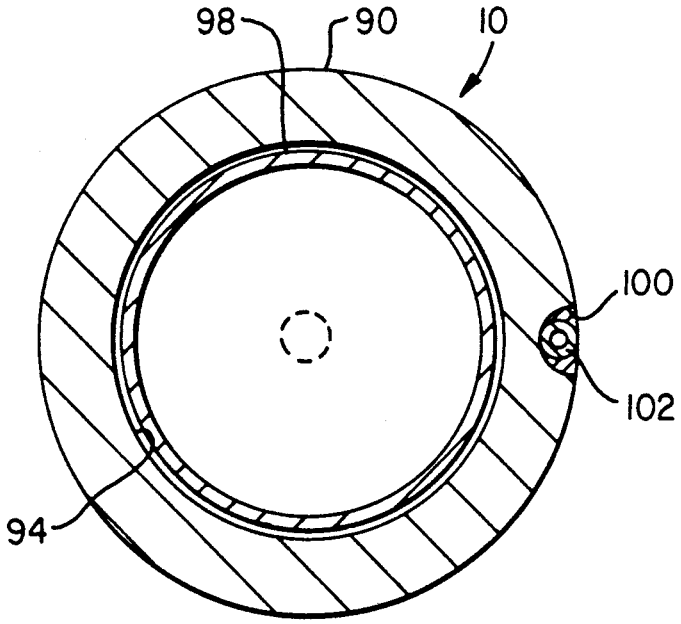
FIG. 3 is a section view taken along the line 3—3 of FIG. 1E.

The housing part 44 is connected to an elongated cylindrical housing part 90 by way of a suitable threaded coupling 92, FIG. 1D. The housing 90 includes a relatively large internal cavity 94, FIG. 1E, which is adapted to contain suitable electrical circuitry in an enclosure 98 for use in conjunction with certain wellbore fluid measuring instruments to be further described herein. The conductor wires 17 extend from the connectors 56 to the enclosure 98 for conducting signals between the enclosure and suitable instrumentation or command or recording circuitry disposed at the surface when the tool 10 is disposed in a wellbore. As shown in FIGS. 1E and 3, the housing part 90 includes an elongated axially extending groove 100 formed in the periphery thereof and in which groove fluid conducting means comprising a tube 102 is disposed and suitably secured in the groove such as by soldering or welding the tube in place. The tube 102 extends toward the end of the housing part 90 opposite the end which is connected to the housing part 44.

Suitable transverse passages 104 and 106, FIG. 1E, place the flow passage of the tube 102 in communication with the circumferential groove 74 and a circumferential groove 108, respectively. The groove 108 is formed in an intermediate coupling 110 of the tool 10. The coupling 110 is suitably threadedly connected to the housing part 90 as illustrated in FIG. 1E. A central wireway passage 111 extends through the coupling 110 and a fluid passage 109, in communication with the groove 108 and a groove 112, is also formed in the coupling part 110 and is in flow communication with a fluid conducting tube 114 disposed on the periphery of a third housing part 116, similar to the housing part 90. The housing part 116 is also threadedly connected to the coupling 110. A transverse passage 115 communicates the groove 112 with the tube 114. Suitable o-ring seals 107 prevent fluid leakage between the parts 90 and 44, between the parts 90 and 110 and between the parts 110 and 116, as well as certain other components of the tool 10, as illustrated.

Figure 1F:
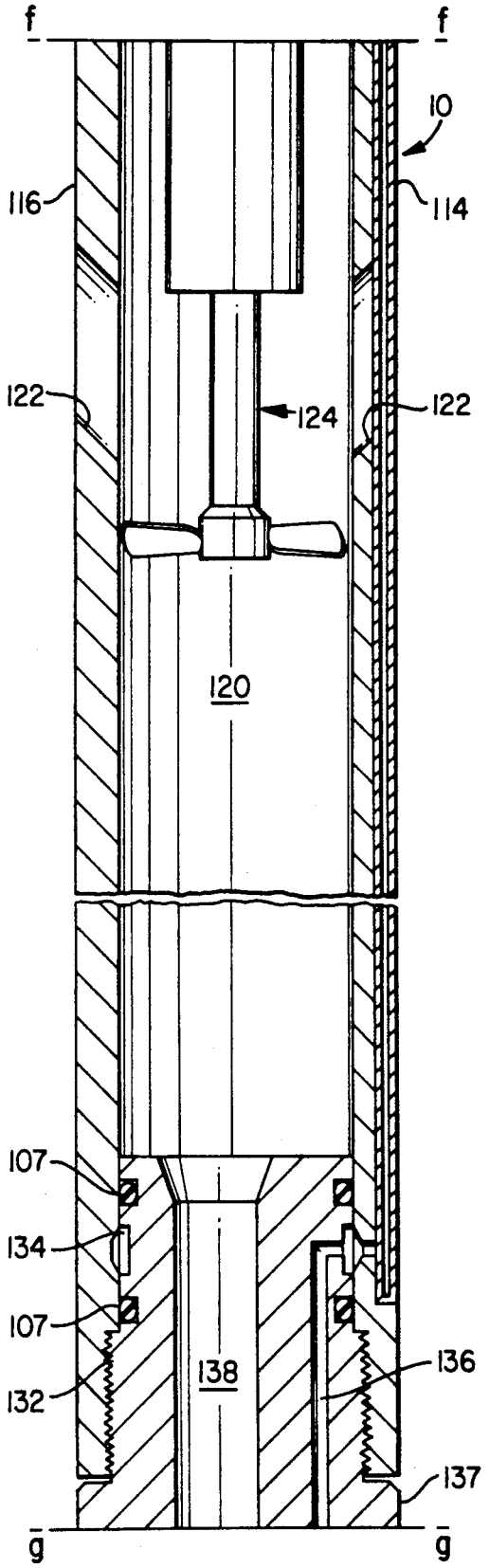

As shown in FIG. 1F, the housing part 116 also comprises an elongated, generally cylindrical member having a large-diameter internal cavity 120 in communication with suitable fluid exit ports 122. A turbine-type flowmeter 124 is supported in the housing part 116 and disposed in the cavity 120 to measure the flow of fluid through the cavity and out of the exit ports 122. Other suitable measuring instruments may be located in the cavity 120 or in certain passages leading thereto and to be described hereinbelow, such as instruments which determines the composition, temperature, density and/or the pressure of the fluid flowing through the cavity 120. The flowmeter 124 may be of a type manufactured by Halliburton Company, Ft. Worth, Tex.

Figure 1G:
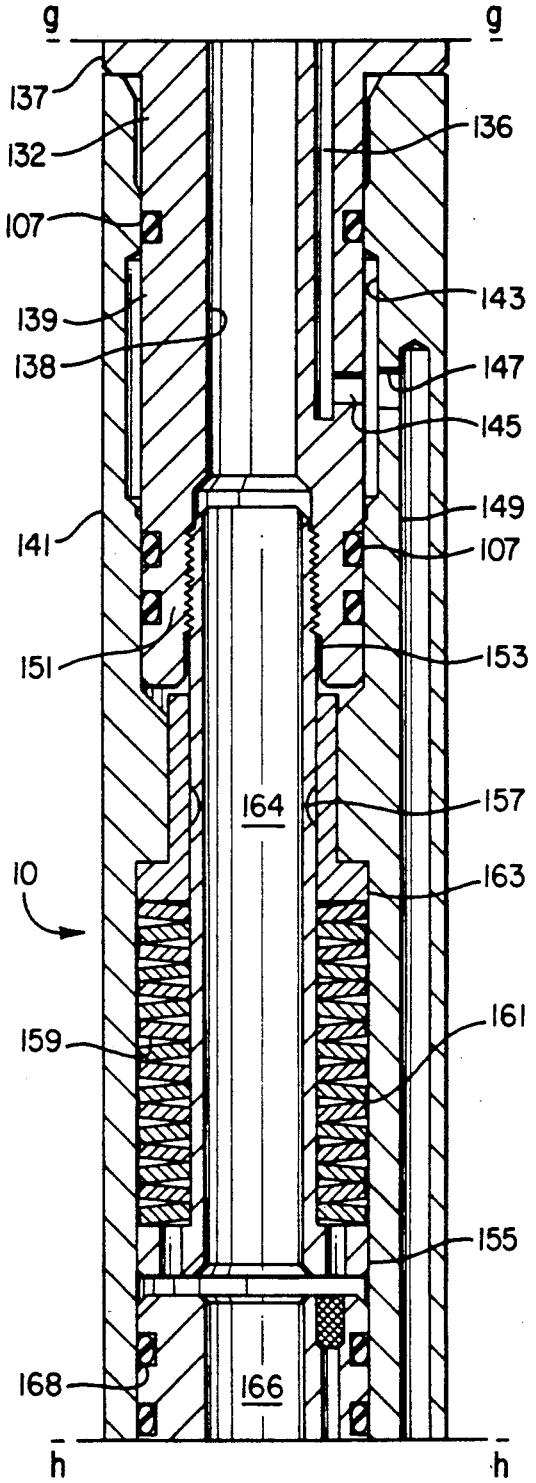
Figure 1H:
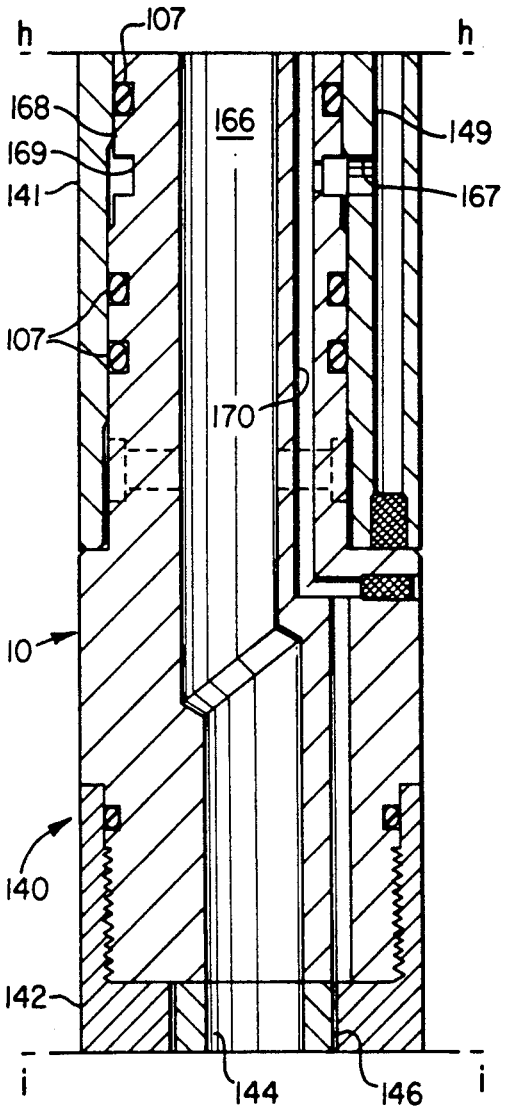

The housing part 116 is threadedly coupled to another coupling 132 which includes a circumferential groove 134 formed therein, an elongated passage 136 in communication with the groove and a wellbore fluid flow passage 138 extending therethrough. Referring now to FIG. 1G, the coupling 132 includes a transverse flange portion 137 and an elongated reduced diameter portion 139 which extends into a housing part 141 having a suitable bore portion 143 which has an internal profile adapted to receive a suitable fishing tool, not shown. The passage 136 communicates by way of transverse passages 145 and 147 with an elongated, longitudinal fluid conducting passage 149 formed in the housing part 141.

The distal end 151 of the coupling portion 139 is internally threaded and is threadedly coupled to frangible coupling means comprising an elongated tubular bolt 153 having a head portion 155 and a reduced diameter neck portion 157 which is of a predetermined diameter to separate under a suitable tensile load tending to pull the coupling 132 away from the housing part 141. The bolt 153 is disposed in a bore 159, formed in the housing part 141 and a plurality of bellville springs 151 are interposed between the head 155 and a flanged collar 163 also disposed in the bore 159. Under a steady, predetermined tensile force exerted on the coupling 132 in an upward direction, viewing FIG. 1G, the portion of the tool 10 above the housing part 141 may be separated from the housing part and those portions of the tool disposed below the coupling 137. As shown in FIG. 1G, the bolt 153 includes a central fluid passage 164 which communicates with the passage 138 and with a passage 166 formed in yet another coupling 168 which is threadedly coupled to the housing part 141.

The coupling 168 is, in turn, connected to wellbore seal means comprising an inflatable packer, generally designated by the numeral 140, and such coupling may form a integral portion of the packer. The packer 140 may be of a type commercially available such as a modified type CT packer available from TAM International, Inc., Houston, Tex. The packer 140 includes a suitable annular bladder element 142 which is adapted to be urged radially outwardly into engagement with a wellbore wall to form a substantially fluid-tight seal with such wall so that wellbore fluids wanting to flow upward in the wellbore are forced to pass through a central passage 144 formed in a substantially rigid tubular mandrel 146 comprising part of the packer 140. Pressure fluid for inflating or radially distending the bladder 142 is provided through the passage 149, a transverse passage 167, an annular groove 169 in the coupling 168 and a generally longitudinal passage 170 extending through the coupling 168.

Figure 1I:
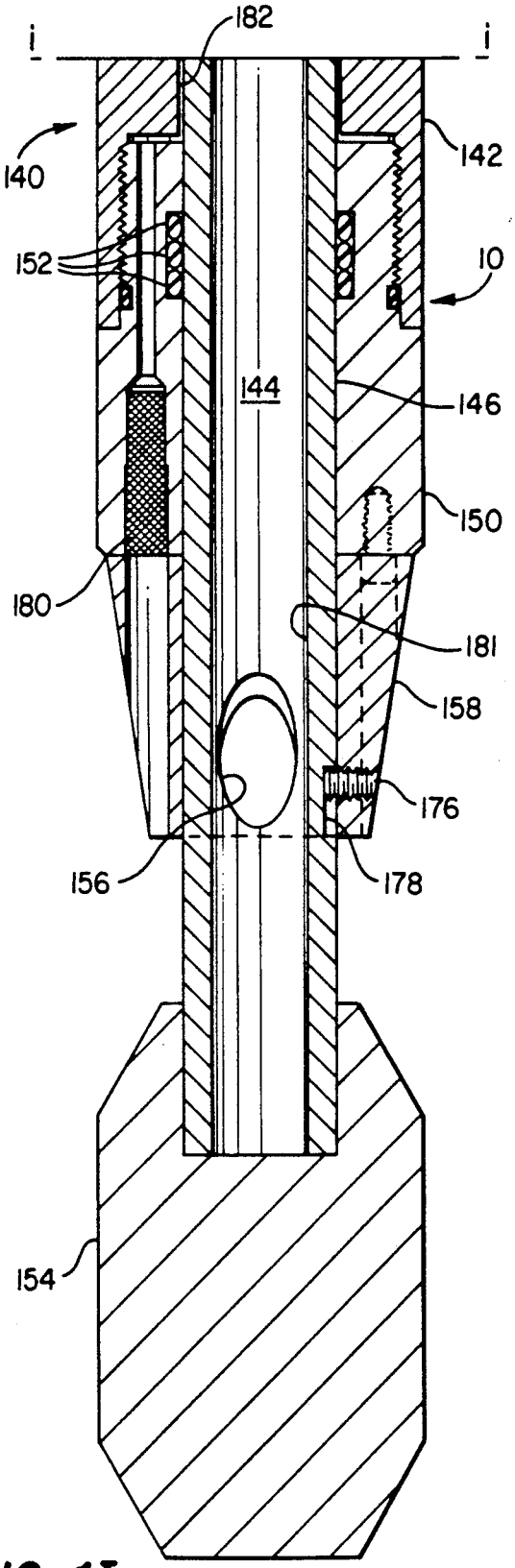

Referring now to FIG. 1I, the lower end of the packer 140 is provided with a substantially rigid end part 150 which is disposed in sleeved and sliding relationship over the mandrel 146 and is suitably connected to the distendable bladder 142. Suitable seals 152 are interposed between the end part 150 and the outside surface of the mandrel 146. The passage 144 extends to the end of the mandrel 146 and is closed at its lower end by a centralizer plug 154 secured to the mandrel. Fluid inlet port means 156 are provided in the side wall of the mandrel 146 and are normally closed by a closure part 158 secured to the lower end of the end part 150. The closure part 158 is provided with a shear screw 176 which extends into a slot 178 formed in the exterior surface of the mandrel 146. An overpressure relief plug 180 is disposed in the end part 150 and is in communication with the space 182 formed between the bladder 142 and the mandrel 146 to prevent overpressure in the bladder during inflation or distention thereof. Thanks to the arrangement of the fluid inlet ports 156 and the closure member 158, when the tool 10 is inserted in a wellbore fluid is prevented from flowing through the central passages which communicate with the instruments such as the flowmeter 124 until the tool is ready for use and the packer bladder 142 has been extended radially into position to seal off the wellbore. As the bladder 142 is subjected to increasing fluid pressure in the space 182 the end part 150 and the closure part 158 will be urged to move upwardly, viewing FIG. 1I in sliding relationship to the mandrel 146. At a predetermined force, resulting from distention of the bladder 142 outwardly, the screw 176 will shear at the interface between the bore 181 in the end part 158 and the exterior surface of the mandrel 146 to allow the end part 150 to move freely upwardly uncovering the port 156 as the bladder 142 moves into sealing engagement with the wellbore wall.

The operation of the tool 10 is believed to be readily understandable from the foregoing description of its components and their function. However, briefly, the tool or apparatus 10 is inserted in a wellbore, preferably at the end of a coilable tubing 14 and, when positioned in the desired location in the wellbore, the packer 140 is actuated to radially distend the bladder 142 to form a fluid-tight seal in the wellbore. Pressure fluid is conducted down through the coilable tubing 14 to act on the piston face 60 of the valve closure member 58 to shift the closure member from the position illustrated in FIG. 1D to a second position in which the passages 64, 68 are placed in communication with the passage 72, 73 while the passage 76 is blocked from communicating with the passage 72.

In the second position of the valve closure member 58 pressure fluid is conducted to the packer 140 by way of the passage 72, 73 the tube 102, the passage 109, the tube 114, the passage 136, the passage 149 and the passage 170 to the space 182. As the packer element 142 radially distends into engagement with the wellbore wall the end part 150, 158 shifts upwardly, viewing FIG. 1I, to uncover the inlet port 156 allowing fluid to flow upward, viewing the drawing figures, through the passages 144, 166, 164 and 138 into the cavity 120 and then out through the ports 122 into the wellbore above the packer element 142.

In the unlikely event that the packer 140 should become stuck in the wellbore a substantial part of the tool 10 may be removed from the wellbore by exerting an upward tensile force on the tool portion which extends above the coupling part 139 until the frangible coupling formed by the bolt 153 separates at the weak point 157 whereby only the portion of the tool including the housing part 141 and the packer 140 remain in the wellbore. In this way expensive instrumentation such as the flowmeter 124 and a major portion of the tool 10 may be removed from the well even though the packer becomes stuck.

The tool 10 may, of course, be selectively positioned in the wellbore from time to time by allowing the fluid pressure in the cavity 50, FIG. 1D to subside. Pressure may be relieved at the surface through the tubing 14.

When pressure fluid is conducted down through the tubing 14 to act on the piston face 60 the flow of fluid through the passages 64, 66 and 70 is restricted at the juncture of the passages 64 and 66 by the adjustable throttling valve 67. Accordingly the pressure at which the closure member 58 shifts to a position to place the recess 59 in communication with the passages 68 and 72 to permit flow of fluid to the passage 72, 73 while blocking communication between the passages 73 and 76 may be adjusted. When the valve closure member 58 is in the second position described the passages 66 and 70 are blocked from communicating with each other. The pressure relief valve 82 may be set at a pressure to also prevent overpressuring the extensible bladder 142.

Fluid pressure may be allowed to subside in the bore 50 by providing the valve closure member 24 to be not absolutely fluid-tight when it rests against the seat 26 but only to provide substantial backflow of fluid up the tubing string 14. Accordingly, when pressure is relieved in the tubing 14 the valve closure member 58 will shift back to the position shown in FIG. 1D to allow pressure fluid to bleed away from space 182 through the passages between that space and the valve closure member so that fluid may be communicated from the passage 73 through the bore portion 56 and out into the wellbore by way of the passage 76 and the low pressure check valve 84.

The tool 10 may be constructed of conventional engineering materials used for downhole tools of a similar type. Those skilled in the art will appreciate that certain functions described herein for certain elements such as the closure member 58 may be controlled by other means such as a suitable electric motor including a solenoid-type actuator for shifting the closure member from the position illustrated to the aforedescribed second position. Moreover, although a preferred embodiment of the present invention has been described in detail, those skilled in the art will recognize that various substitutions and modifications may be made to the tool described without departing from the scope and spirit of the invention as recited in the appended claims.

What is claimed is:

1. A tool for insertion into a wellbore for determining one of a selected property and condition of fluid being produced in the wellbore, said tool being adapted to be inserted in the wellbore at the end of an elongated tubing string, said tubing string being adapted to conduct pressure fluid to said tool, said tool being characterized by:

connector means for connecting said tool to said tubing string;

housing means connected to said connector means and including passage means therein for receiving pressure fluid from said tubing string;

fluid pressure actuated seal means on said tool responsive to receiving pressure fluid from said tubing string for forming a substantially fluid-tight seal in said wellbore;

means associated with said seal means including a wellbore fluid flow passage for conducting wellbore fluid through said packer;

valve means normally closing said wellbore fluid flow passage and responsive to communication of pressure fluid to said seal means to move to open said wellbore fluid flow passage to said wellbore; and valve means in said tool for controlling the flow of pressure fluid to said seal means from said tubing string for causing said seal means to form said seal, said valve means including a closure member operable by pressure fluid from said tubing string to move from a first position to a second position for communicating pressure fluid to said seal means.

2. The tool set forth in claim 1 wherein:

said housing means includes passage means therein for communicating pressure fluid from said seal means to the exterior of said tool when said closure member is in said first position.

3. THe tool set forth in claim 1 wherein:

said housing means includes a first housing part having a cavity therein for receiving electrical circuit means and said passage means includes a longitudinal passage extending along said first housing part and bypassing said cavity.

4. The tool set forth in claim 3 wherein:

said longitudinal passage extends along the periphery of said first housing part.

5. The tool set forth in claim 4 wherein:

said longitudinal passage is formed by tube means secured to said first housing part.

6. The tool set forth in claim 3 wherein:

said housing means includes a second housing part including a cavity formed therein and defining a flow path for wellbore fluid flowing through said tool, said cavity being in communication with exit port means, a flowmeter disposed in said second housing part and means forming a longitudinal passage in said second housing part and extending through said second housing part between said first housing part and said seal means.

7. The tool set forth in claim 6 including:

coupling means between said first housing part and said second housing part and including passage means for communicating pressure fluid between said longitudinal passages in said housing parts, respectively.

8. The tool set forth in claim 7 including:

frangible coupling means interconnecting said housing means with said seal means and responsive to a pulling force on said housing means to separate said housing means from said seal means.

9. The tool set forth in claim 8 wherein:

said frangible coupling means includes a frangible member having passage means therein for conducting wellbore fluid to s id second housing part.

10. A tool for insertion into a wellbore for determining one of a selected property and condition of fluid being produced in the wellbore, said tool being adapted to be inserted in the wellbore at the end of an elongated tubing string, said tubing string being adapted to conduct pressure fluid to said tool, said tool being characterized by:

connector means for connecting said tool to said tubing string;

housing means connected to said connector means and including passage means therein for receiving pressure fluid from said tubing string;

fluid pressure actuated seal means on said tool responsive to receiving pressure fluid from said tubing string for forming a substantially fluid-tight seal in said wellbore;

said housing means includes a first housing part including a cavity formed therein and defining a flow path for wellbore fluid to flow through said tool, said cavity being in communication with exit port means, and instrument means disposed in said cavity and;

frangible coupling means interconnecting said housing means with said seal means including a frangible member having passage means therein for conducting wellbore fluid between said cavity and said wellbore and responsive to a predetermined pulling force on said housing means to separate said housing means from said seal means.

11. The tool set forth in claim 10 wherein:

said housing means includes passage means therein for communicating pressure fluid from said seal means to the exterior of said tool.

12. The tool set forth in claim 10 including:

means forming a longitudinal passage in said first housing part and extending through said first housing part between said connector means and said seal means for conducting pressure fluid to said seal means from said tubing string.

13. The tool set forth in claim 12 wherein:

said housing means includes a second housing part between said connector means and said seal means and having a longitudinal passage extending along said second housing part and in fluid flow communication with said longitudinal passage in said first housing part.

14. The tool set forth in claim 12 including:

valve means in said tool for controlling the flow of pressure fluid to said seal means from said tubing string for causing said seal means to form said seal, said valve means including a closure member operable by pressure fluid from said tubing string to move from a first position to a second position for communicating pressure fluid to said seal means.

15. The tool set forth in claim 14 wherein:

said housing means includes passage means therein for communicating pressure fluid from said seal means to the exterior of said tool when said closure member is in said first position.

16. A tool for insertion into a wellbore for determining one of a selected property and condition of fluid being produced in the wellbore, said tool being adapted to be inserted in the wellbore at the end of an elongated tubing string, said tubing string being adapted to conduct pressure fluid to said tool, said tool being characterized by:

connector means for connecting said tool to said tubing string;

housing means connected to said connector means and including passage means therein for receiving pressure fluid from said tubing string;

fluid pressure actuated seal means on said tool responsive to receiving pressure fluid from said tubing string for forming a substantially fluid-tight seal in said wellbore;

means associated with said seal means including a wellbore fluid flow passage for conducting wellbore fluid through said packer; and valve means normally closing said wellbore fluid flow passage and responsive to communication of pressure fluid to said seal means to move to open said wellbore fluid flow passage to said wellbore.

* * * * *